US005331297A

United States Patent [19]

Kubo et al.

[11] Patent Number: 5,331,297

[45] Date of Patent: Jul. 19, 1994

[54] JOSEPHSON DEVICE A.C. POWER SUPPLY CIRCUIT AND CIRCUIT SUBSTRATE FOR MOUNTING SAME

[75] Inventors: Takanori Kubo; Shigeo Tanahashi, both of Kagoshima, Japan

[73] Assignee: Kyocera Corporation, Kyoto, Japan

[21] Appl. No.: 993,124

[22] Filed: Dec. 18, 1992

[30] Foreign Application Priority Data

Dec. 26, 1991 [JP] Japan ..... 3-345314
Sep. 30, 1992 [JP] Japan ..... 4-261652

[51] Int. Cl.[5] ..... H01P 5/12

[52] U.S. Cl. ..... 333/127; 333/128; 307/306; 505/865

[58] Field of Search ..... 333/995, 127, 128; 307/306, 476; 505/865

[56] References Cited

U.S. PATENT DOCUMENTS 4,603,263 7/1986 Tahara et al. ..... 307/306 X

FOREIGN PATENT DOCUMENTS 232502 9/1988 Japan ..... 333/128
98201 4/1990 Japan ..... 333/128

OTHER PUBLICATIONS

*Handbook of Tri-Plate Microwave Components,* Sanders Assoc., Nashua, N.H., 1956, p. 71 relied on.

*Primary Examiner*—Paul Gensler
*Attorney, Agent, or Firm*—Spensley Horn Jubas & Lubitz

[57] ABSTRACT

An impedance-matching circuit assembly supplies a.c. power from an external a.c. source to Josephson devices. The assembly comprises resonant-line composed quarter-wave impedance conversion circuits, interconnected in a tree. The impedance-conversion circuits are assembled such that connected to the a.c. source is a circuit having a first-stage impedance, followed by two circuits having second-state impedances connected in parallel, to each of which are connected in parallel two circuits having third-stage impedances, each of which in turn is connected to supply input terminals of two of the Josephson devices.

29 Claims, 9 Drawing Sheets

JOSEPHSON DEVICE A.C. POWER SUPPLY CIRCUIT AND CIRCUIT SUBSTRATE FOR MOUNTING SAME

BACKGROUND OF THE INVENTION

The present invention relates to a power supply circuit and a circuit substrate, particularly to a circuit for supplying alternating-current power to a Josephson device, and to a circuit substrate which incorporates the a.c. power supply circuit, and which serves as a mount for a Josephson device.

Josephson devices, which effect ultra-high speed operation under superconductivity at very low temperatures, are immersed into a container of a coolant such as liquid helium. An alternating-current power supply circuit is provided for connecting the Josephson devices with an external a.c. source, located outside of the container.

Since there are a number of gates in the Josephson device, a larger supply current is required even though the gates individually consume less power. The diameter of an external feed cable must therefore be of sufficient magnitude to carry the larger current; however sealing problems can arise due to endothermic breakdown at the bond between the cable and the container, impairing airtightness therein. To overcome this, a feed cable having a smaller diameter can be employed, wherein power is supplied at higher voltage and lower current. Meanwhile, the Josephson device requires the larger current, such that it becomes necessary to convert the power into a lower voltage and a higher current.

Japanese Patent Gazette Publication No. 30208/1990 discloses an alternating-current power supply circuit including a superconducting thin film inductor, and a capacitor having electrodes formed of superconducting material, wherein the power is converted into a lower voltage and a higher current by resonant lines.

Therein, the a.c. power supply circuit must necessarily be manufactured of superconducting materials. Accordingly, wherein the power supply circuit is manufactured with the Josephson device-mounting circuit substrate, fabricated from an insulative substrate material, it must be formed onto the substrate by thin-film coating technique. The a.c. power supply circuit will consequently occupy a larger area on the substrate, requiring that the substrate itself be of corresponding size. Moreover, manufacture of the circuit substrate is quite difficult, owing to the complex structure of the superconducting-material formed a.c. power supply circuit.

SUMMARY OF THE INVENTION

It is an object of the present invention to facilitate the manufacture of a circuit for supplying a.c. power to a Josephson device.

It is another object of the present invention to reduce the size of a circuit substrate to which a Josephson device is mounted.

It is a further object of the present invention to reduce ground noise in a Josephson-device mounting circuit substrate incorporating an a.c. power supply device situated between grounding circuits.

According to an aspect of the present invention, the a.c. power supply device supplies power from an external source to a Josephson device. This device comprises a plurality of impedance conversion circuits composed of resonant lines interconnected in a tree between the power source and source input terminals of the Josephson device.

The power is converted into a lower voltage and a higher current in the a.c. power supply device by the plurality of impedance conversion circuits interconnected in the tree configuration, and is supplied to the source input terminals of the Josephson device. It is unnecessary to fabricate the a.c. power supply device from superconducting material, and therefore the device can be manufactured embodied within the circuit substrate to which the Josephson device is mounted, thus making it possible to reduce the size of the circuit substrate.

A Josephson-device mounting circuit substrate according to another aspect delivers power from dual a.c. supplies, 180° out of phase relative to each other, to the Josephson device. The circuit substrate comprises first and second a.c. power supply circuits formed of patterned circuit paths, first and second patterned grounding circuits, and an circuit insulating support.

The first and second a.c. power supply circuits are disposed in lamina between the first and second grounding circuits, and interspaced in their tiering direction. The first and second grounding circuits are connected to each circuit is formed, and support is a substructure in which each circuit is formed, and supports the Josephson device. Thus according to the invention in this aspect, wherein a.c. power is delivered, in dual supplies 180° out of phase, to the first and second a.c. power supply circuits disposed between the first and second grounding circuits, balanced power supply is achieved. The balanced power supply reduces ground noise at the first and second grounding circuits.

The foregoing and other objects, aspects and advantages of the present invention will become apparent from the following detailed description.

DESCRIPTION OF THE PREFERRED EMBODIMENTS

First Embodiment

Figure 1:
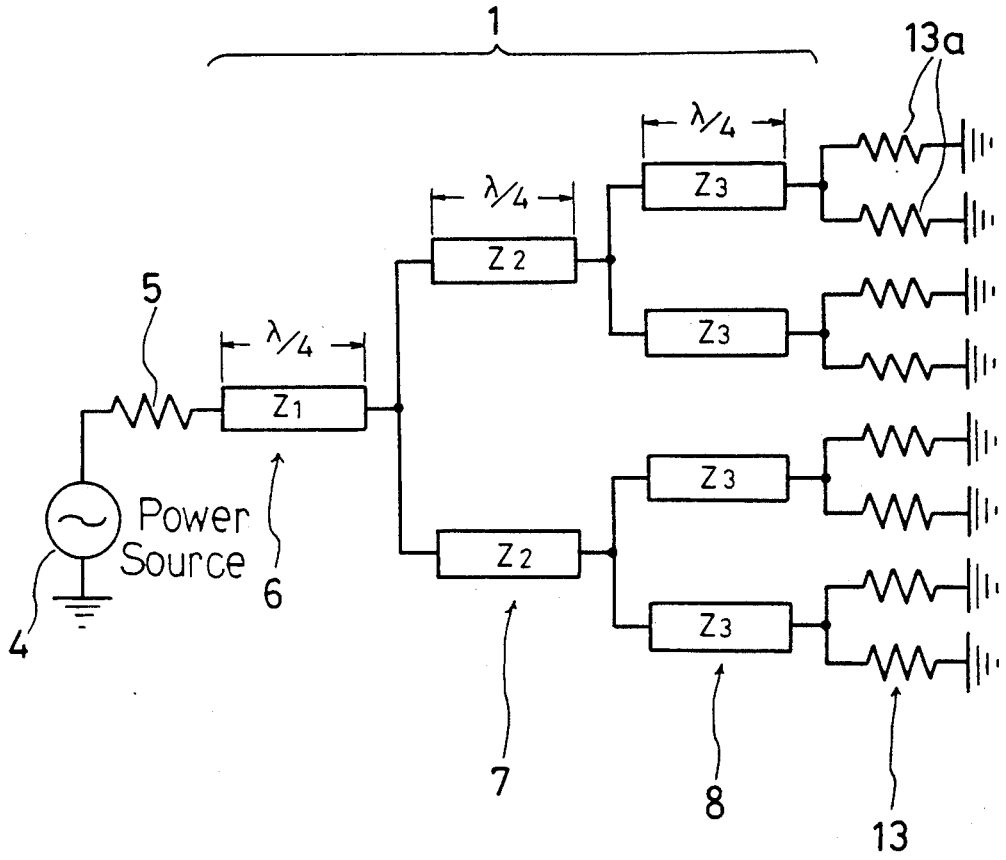
FIG. 1 is an equivalent circuit diagram of an a.c. power supply circuit according to an embodiment of the present invention.

Referring to FIG. 1, the a.c. power supply circuit 1 therein is shown to have input terminals connected to an external a.c. source 4 and output terminals connected to a plurality of source input terminals 13*a* of a Josephson device 13 (described later). The external a.c. source 4 supplies alternating current at 1 GHz through coaxial cables, and it has an internal impedance (internal resistance 5) of 50 ohms. On the other hand, each Josephson device 13 has an internal impedance (internal resistance 13*a*) of 6.25 ohms. The circuit 1 is therefore provided to match the impedance of the a.c. source 4 to that of the Josephson device 13.

The a.c. power supply circuit 1 is composed of quarter-wave impedance conversion circuits 6, 7 and 8, which consist of resonant lines having length $(2n-1)/4$ [where n is a natural number (positive integer)] of the supply current wavelength (one quarter-wave length in this case). The quarter-wave impedance conversion circuits 6, 7 and 8 are interconnected between the a.c. source 4 and the Josephson device 13 in a tree as follows: The first stage, quarter-wave impedance-conversion circuit 6 is connected to the a.c. source 4; two second stage, quarter-wave impedance-conversion circuits 7 are connected to the first stage impedance-conversion circuit 6 in parallel; two third stage, quarter-wave impedance-conversion circuits 8 are connected to each second stage impedance-conversion circuit 7 in parallel; and two Josephson devices 13 are connected to each third stage impedance conversion circuit 8. Accordingly, the first stage quarter-wave impedance-conversion circuit 6 has an impedance of 25 ohms, the second stage quarter-wave impedance-conversion circuit 7, 12.5 ohms, and the third stage quarter-wave impedance-conversion circuit 8, 6.25 ohms.

Figure 2:
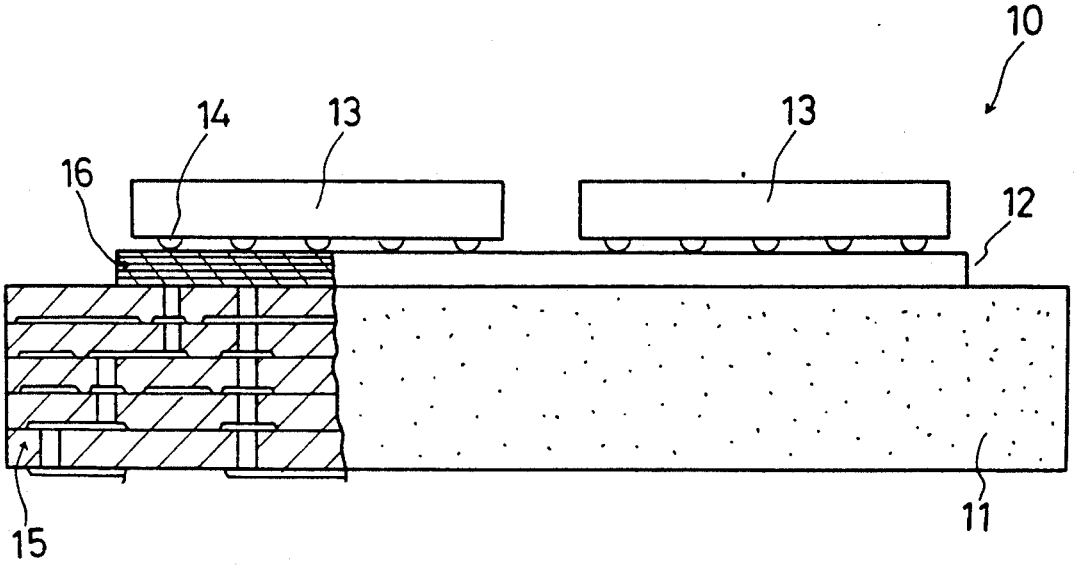
FIG. 2 is a partially cut-away side view of a circuit substrate to which a Josephson device is mounted as an embodiment of the present invention.

Referring to FIG. 2, a circuit substrate 10 illustrated therein is composed chiefly of an insulating support 11 made of mullite ceramic and a polyimide dielectric laminate 12 formed on the insulating support 11. A plurality of Josephson devices 13 are fixed onto the dielectric laminate 12 though soldering bumps 14.

Thick-film conductors 15, made of powdered refractory metal such as tungsten or molybdenum, are buried inside the insulating support 11. The thick-film conductors 15 comprise the a.c. power supply device 1, explained with reference to FIG. 1.

Figure 3:
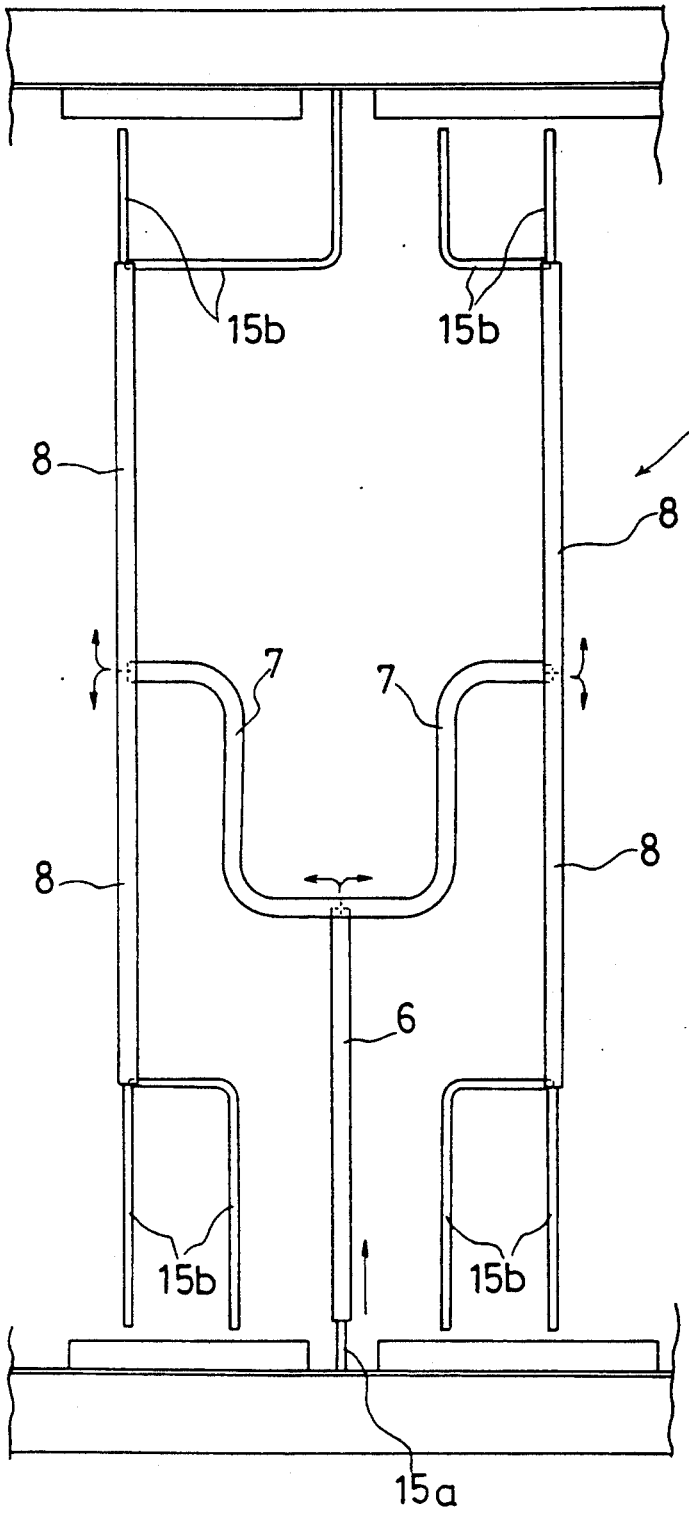
FIG. 3 is a planar partial view showing a pattern of the a.c. power supply circuit of FIG. 2.

Referring to FIG. 3, one terminal of the first stage quarter-wave impedance-conversion circuit 6 is connected to an input terminal 15*a* of the thick-film conductors 15. The second stage quarter-wave impedance conversion circuits 7 branch from the other terminal of the first stage quarter-wave impedance-conversion circuit 6, each extending in an S. The third stage quarter-wave impedance-conversion circuits 8 extend from each of the second stage quarter-wave impedance-conversion circuits 7 in opposite directions. Provided at the ends of the third stage quarter-wave impedance-conversion circuits 8 is a pair of output terminals 15*b* to which power supply terminals of the Josephson device 13 (FIG. 2) are connected.

Thin-film conductors 16 which are layers of copper or niobium are formed inside the dielectric laminate 12. The thin-film conductors 16 constitute signal conductors and are in part connected to the thick-film conductors 15 so as to supply power to the Josephson devices 13.

Next, a method of manufacturing the circuit substrate 10 in FIG. 2 for mounting the Josephson device will be explained.

The insulating support 11 is made of a plurality of ceramic green sheets. The ceramic green sheets are made by adding a proper binder and organic solvent to raw material powders such as mullite, silica, calcia or magnesia, and mixing, so as to make them into a slurry, and then forming the mixture into sheets by the doctor blade method. After the ceramic green sheets are then stamped to form feedthroughs, a metal paste of powdered refractory metal such as tungsten or molybdenum is printed onto the ceramic green sheets by screen printing. The plurality of ceramic green sheets is laminated in order to form a ceramic green sheet-laminate, and the laminate is then sintered in a reducing atmosphere at a temperature of about 1600° C., whereby the insulating support 11, incorporating the thick-film conductors 15 therein, is completed.

The dielectric laminate 12 as manufactured is formed by a photo-lithographic method which includes the step of coating photosensitive polyimide paste onto the insulating support 11 by the spin-coating method. The thin-film conductors 16, multiple layers within the dielectric laminate 12, are deposited by physical vapor deposition, such as sputtering or vacuum evaporating, and formed into a particular pattern by photo-lithography.

The Josephson devices 13 are fixed to the insulating layer 12 through the soldering bumps 14, which thus interconnect the thin-film conductors 16 and the Josephson devices 13.

Since in the abovedescribed manufacturing method of insulating support 11 is manufactured according to a conventionally known ceramic substrate manufacturing method, the thick-film conductors 15 are readily fabricated interiorly. Moreover, the a.c. power supply circuit 1 shown in FIG. 3 is very easy to manufacture, since its structural combination of the impedance-conversion circuits 6, 7 and 8 formed of the resonant lines is simple.

The a.c. power supply circuit 1 is formed, according to the pattern shown in FIG. 3, of the thick-film conductors 15 interior of the insulating substrate, such that less superficial area need be occupied on the insulating support 11, thereby reducing the size of the circuit substrate 10 for mounting the Josephson device.

The operation of the circuit will be explained.

Power supplied from the external a.c. source 4 is characterized by higher voltage and smaller current. The power is converted into a lower voltage and a higher current by the first stage quarter-wave impedance-conversion circuit 6, the second stage quarter-wave impedance-conversion circuits 7, and the third stage quarter-wave impedance-conversion circuits 8 of the a.c. power supply circuit 1, and supplied to the Josephson device 13.

The 50-ohm impedance of the external a.c. source 4 is converted to 25 ohms at the first stage quarter-wave impedance-conversion circuit 6, 12.5 ohms at the second stage quarter-wave impedance-conversion circuits 7, and 6.25 ohms at the third quarter-wave impedance-conversion circuits 8, whereby the impedance of the Josephson devices 13 and the impedance of the supply power are finally matched.

Since the signal conductors constituted by the thin-film conductors 16 are located separately from the thick-film conductors 15 which are the a.c. power supply circuit 1, cross talk from the a.c. power supply circuit 1 to the signal conductors is prevented.

Second Embodiment

Figure 4:
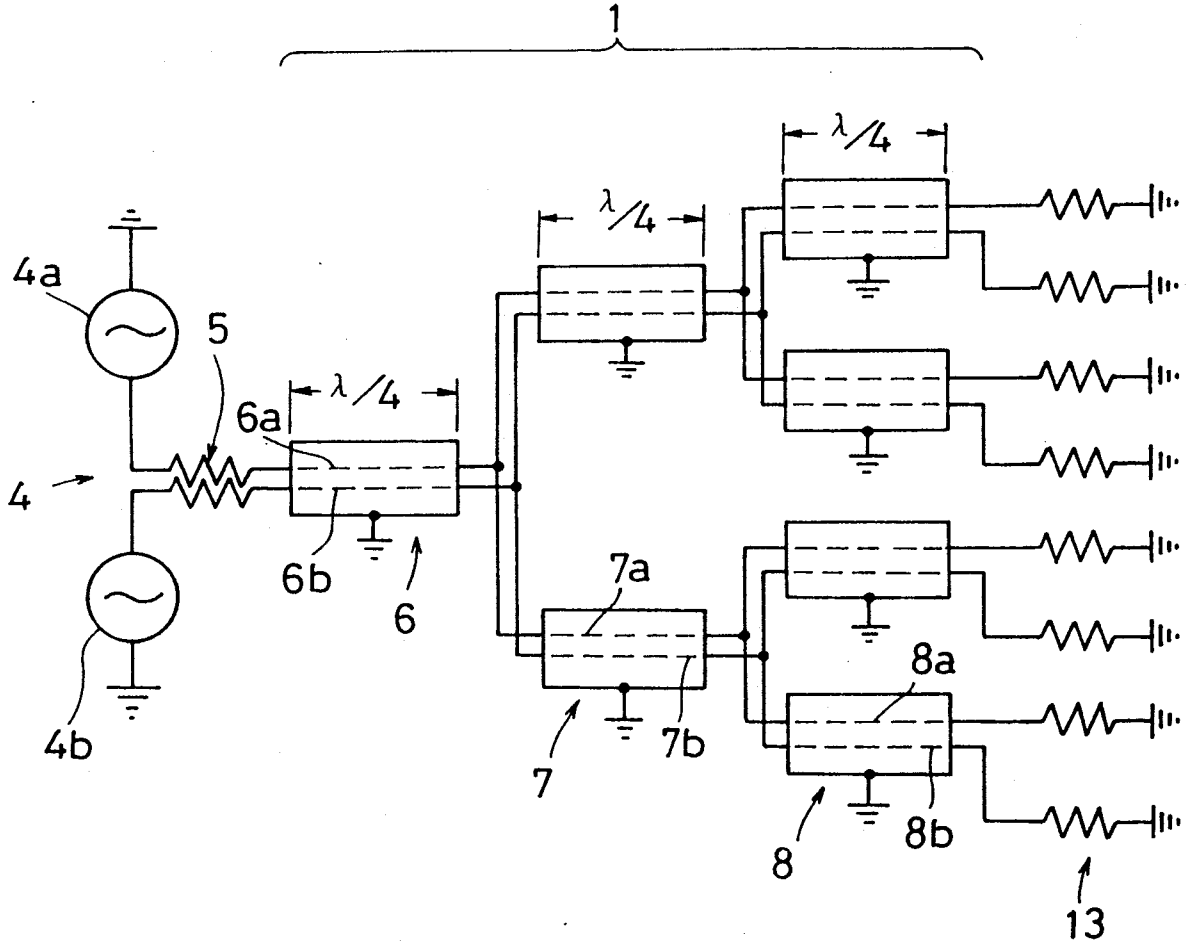
FIG. 4 is an equivalent circuit diagram of the a.c. power supply circuit manufactured according to another embodiment of the present invention.

Referring to FIG. 4, an a.c. power supply circuit 1 according to another aspect of the present invention has input terminals connected to an external a.c. source 4, and output terminals connected to a plurality of Josephson devices 13 (described later).

The external a.c. source 4 is composed of dual a.c. supplies 4*a* and 4*b* which are 180° out of phase (half wavelength) with respect to each other. The external a.c. source 4 supplies 1 GHz alternating current through, for example, coaxial cables and has an internal impedance (internal resistance 5) of 50 ohms. On the other hand, each Josephson device 13 has an internal impedance of 3.1 ohms. The a.c. power supply circuit 1 is provided in order to match impedances of the external a.c. source 4 and the Josephson devices 13.

The a.c. power supply circuit 1 is composed of quarter-wave impedance-conversion circuits 6, 7 and 8, which are resonant lines of length one-quarter that of the supply current wavelength, and which are connected to one another in a tree between the a.c. source 4 and the Josephson devices 13 as follows: the first quarter-wave impedance-conversion circuit 6 is connected to the a.c. source 4. Two second stage impedance-conversion circuits 7 are connected to the first stage quarter-wave impedance conversion circuit 6 in parallel. Two third stage quarter-wave impedance conversion circuits 8 are connected to each second stage impedance-conversion circuit 7 in parallel. The Josephson devices 13 are connected to each third stage impedance-conversion circuit 8. As a result, the first stage quarter-wave impedance-conversion circuit 6 has an impedance of 25 ohms; the second stage quarter-wave impedance-conversion circuit 7, an impedance of 12.5 ohms; and the third stage quarter-wave impedance-conversion circuit 8, an impedance of 6.25 ohms. Each quarter-wave impedance-conversion circuit 6, 7 and 8 is composed of respective pairs of first and second resonant line paths 6*a*/6*b*, 7*a*/7*b*, and 8*a*/8*b*.

Figure 5:
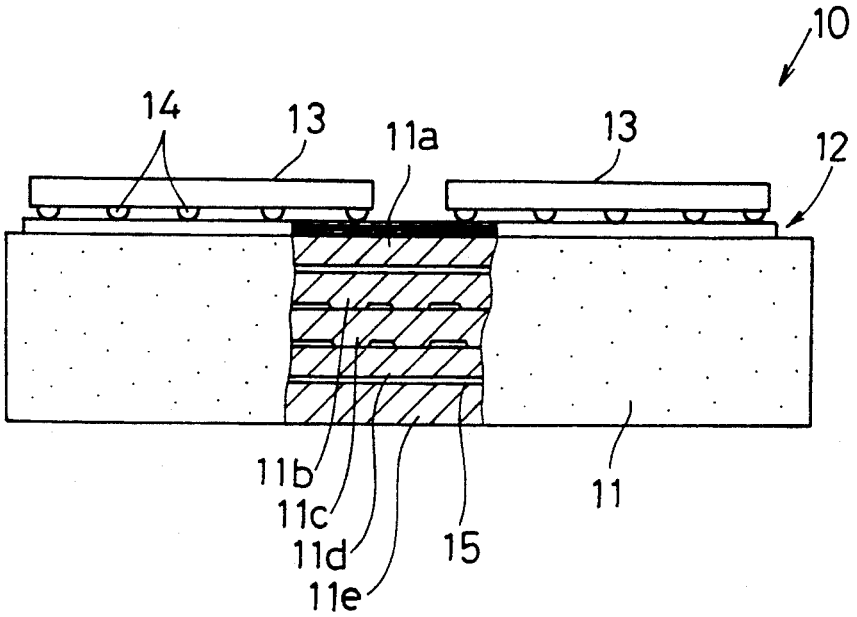
FIG. 5 is a partially cut-away side view of a circuit substrate to which a Josephson device is mounted as another embodiment of the present invention.

A circuit substrate 10 for mounting Josephson devices, as illustrated in FIG. 5, is mainly composed of an insulating support 11 of mullite ceramic, and a polyimide dielectric laminate 12 formed on the insulating support 11. A plurality of Josephson devices 13 are fixed onto the dielectric laminate 12 through soldering bumps 14.

The insulating support 11 embodies ceramic layers 11*a* to 11*e*, made by sintering five laminated ceramic green sheets, and incorporates thick-film conductors 15 therein made of powdered refractory metal such as tungsten or molybdenum. The thick-film conductors 15 define the a.c. power supply circuit 1, as explained with reference to FIG. 4. FIGS. 6 to 9 show sections of impedance-conversion circuit patterns of the thick-film conductors 15.

Figure 6:
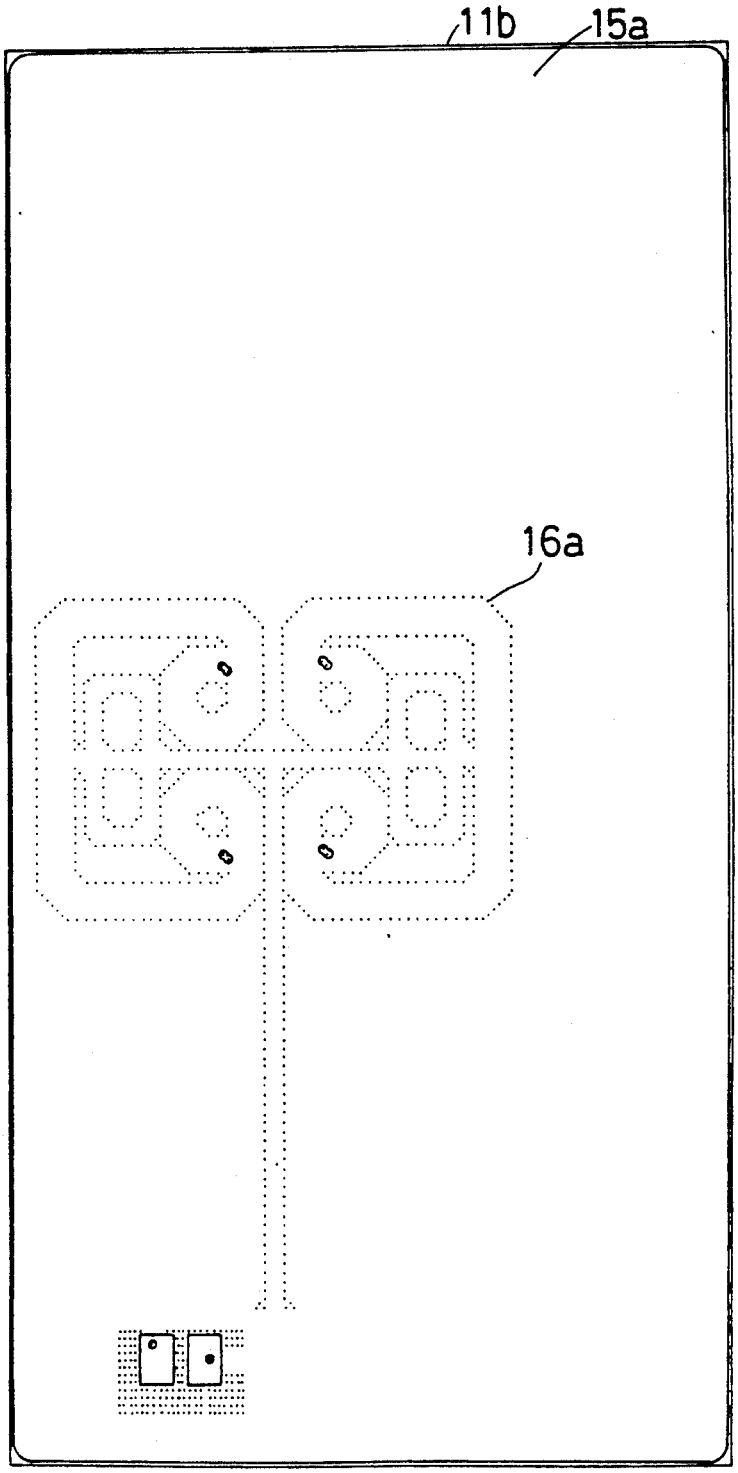
FIGS. 6, 7, 8 and 9 are respective planar views showing circuit patterns of the a.c. power supply circuit.

Referring to FIG. 6, a first circuit-grounding pattern 15*a* is formed on almost the entire area of the ceramic layer 11*b*.

Figure 7:
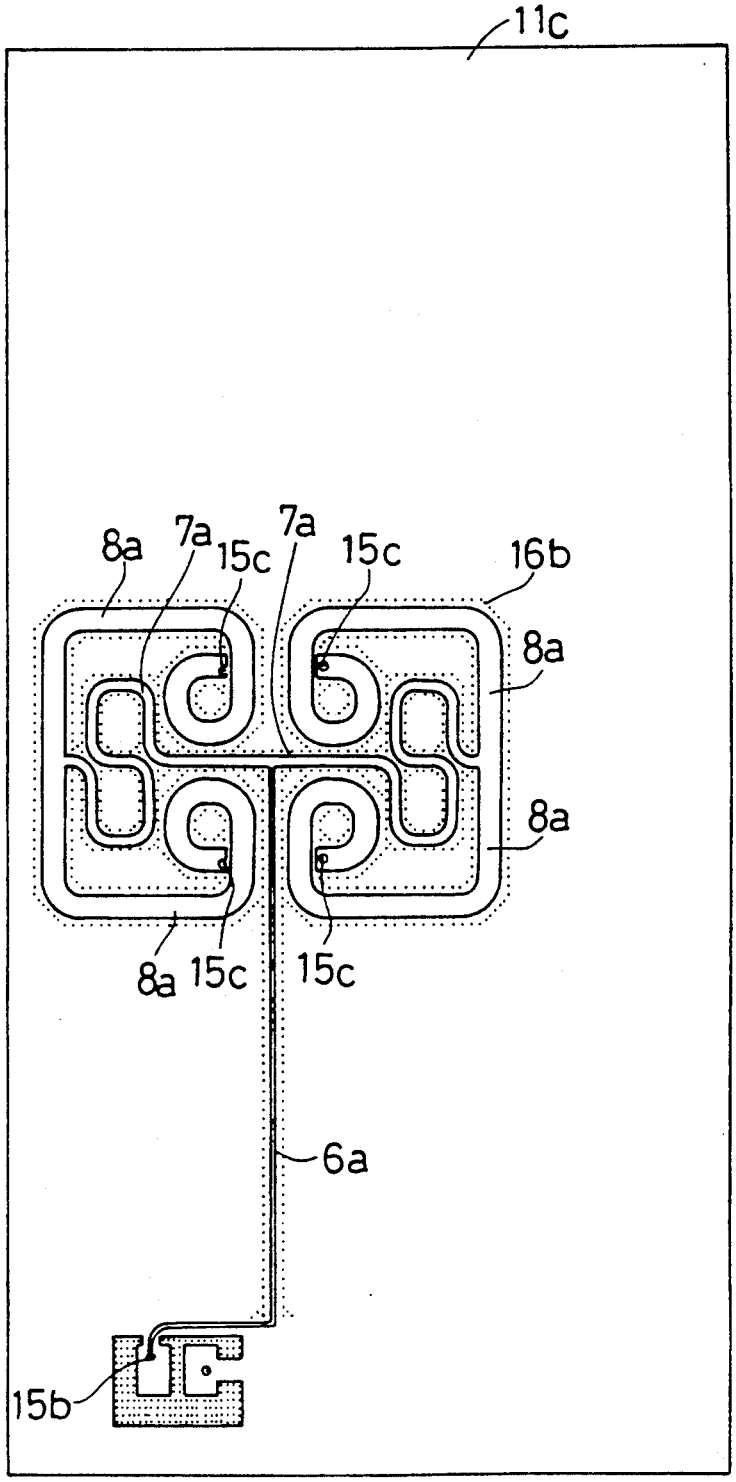

Referring to FIG. 7, the first impedance-conversion circuit resonant line paths 6*a*, 7*a* and 8*a*, which constitute the a.c. power supply circuit 1 formed from the thick-film conductors 15, are patterned on the ceramic layer 11*c*. One end of the resonant line path 6*a*, which path constitutes the first stage quarter-wave impedance-conversion circuit 6, is connected to an input terminal 15*b*. The resonant line paths 7*a*, which constitute the second stage quarter-wave impedance-conversion circuit 7, branch from the other end of the first impedance-conversion resonant line path 6*a* and curve in an S. Two resonant line paths 8*a* extend in opposite directions from distal ends of each resonant line path 7*a*. Each of the four resonant line paths 8*a* is curved in a C, so as to reduce the area in which they are patterned, ending in an approximately 270° curve, at which terminus a pair of output terminals 15*c*, to which power supply terminals of the Josephson devices 13 are connected, is provided.

Figure 8:
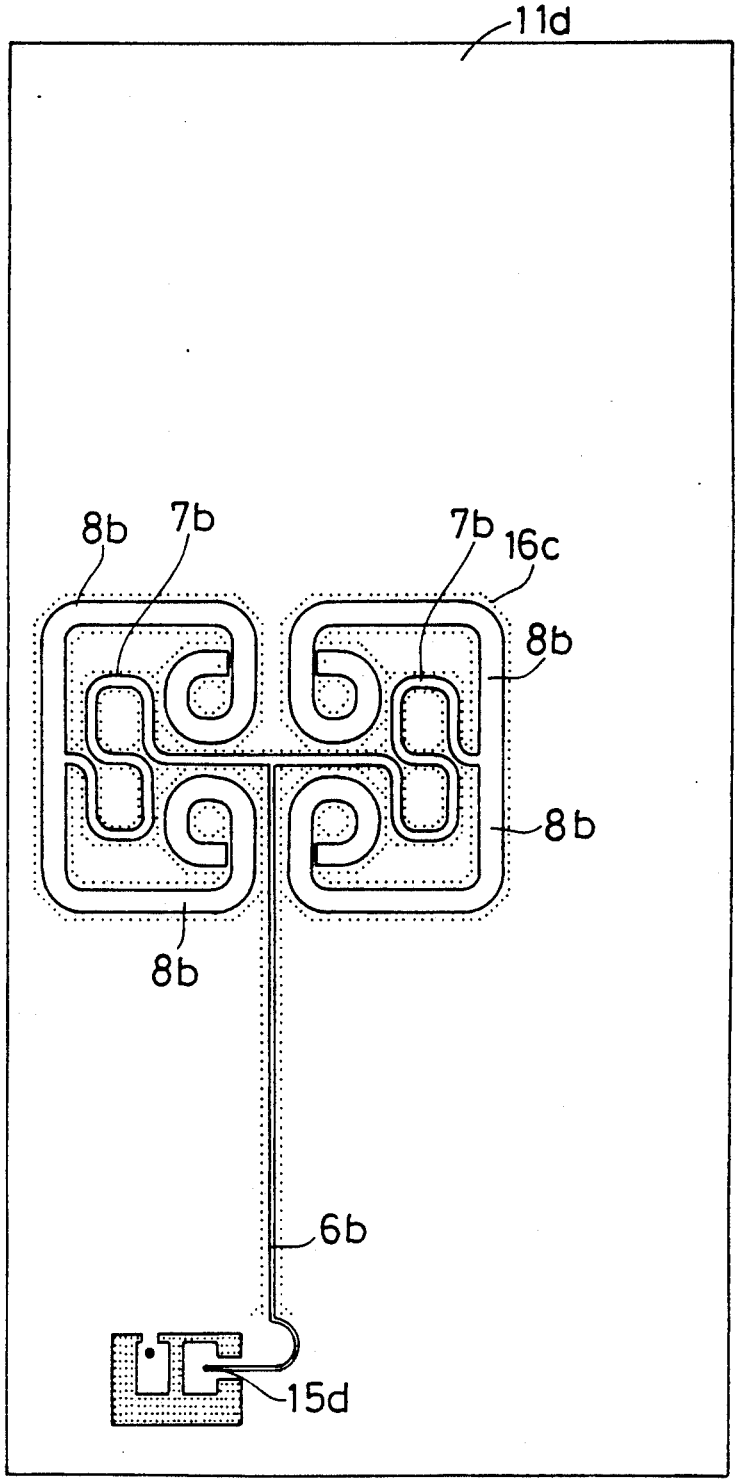

Referring to FIG. 8, second resonant line paths 6*b*, 7*b* and 8*b* are formed on the ceramic layer 11*d* such that the complementary pairs of patterned resonant line paths forming the first and second impedance-conversion circuit patterns lie respectively superimposed.

Figure 9:
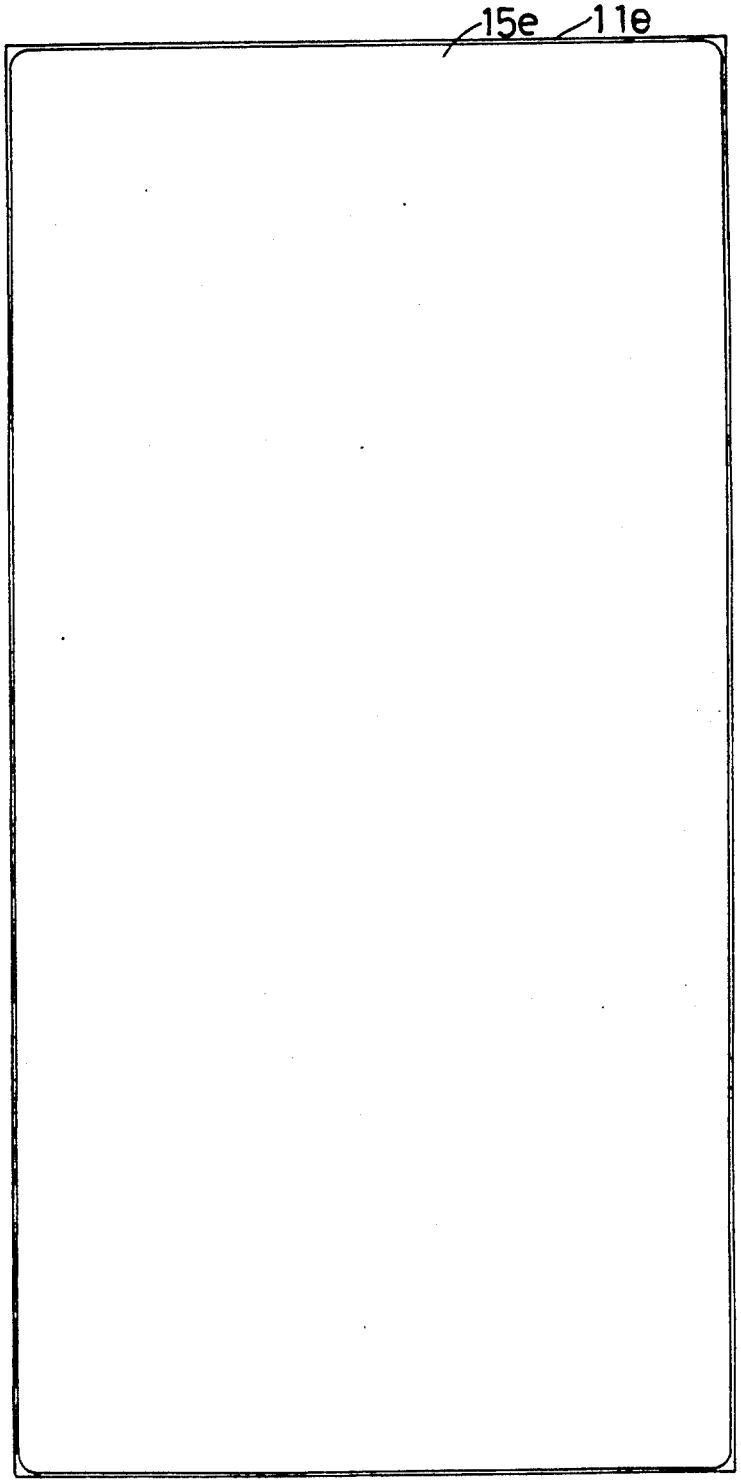

Referring to FIG. 9, a second circuit-grounding pattern 15*e* is formed on almost the entire area of the ceramic layer 11*e*. The first circuit-grounding pattern 15*a* and the second circuit-grounding pattern 15*e* are interconnected via a number of feedthroughs 16*a*, 16*b* and 16*c*, which are formed through the ceramic layers 11*b* to 11*d*. The feedthroughs 16*b* and 16*c* are formed flanking both sides of the circuit patterns 6*a*/6*b*, 7*a*/7*b*, and 8*a*/8*b*, and are filled with metal. Thin-film conductors (not marked) of copper or niobium are formed inside of the dielectric laminate 12 shown in FIG. 5. The thin-film conductors form signal conductors and are in part connected to the thick-film conductors 15 so as to supply power to the Josephson devices 13.

Next, a method of manufacturing the circuit substrate 10 in FIG. 5 for mounting the Josephson device will be explained.

The insulating support 11 is made of a plurality of ceramic green sheets. The ceramic green sheets are made by adding a proper binder and organic solvent to raw material powders such as mullite, silica, calcia or magnesia, and mixing, so as to make them into a slurry, and then forming the mixture into sheets by the doctor blade method. After the ceramic green sheets are stamped to form feedthroughs, a metal paste of powdered refractory metal such as tungsten or molybdenum is printed on to the ceramic green sheets by screen printing. The plurality of ceramic green sheets is laminated in order to form a ceramic green sheet-laminate and the laminate is then sintered in a reducing atmosphere at a temperature of about 1600° C., whereby the insulating support 11, incorporating the thick-film conductors 15 therein, is completed.

The dielectric laminate 12 as manufactured is formed by a photo-lithographic method which includes the step of coating photosensitive polyimide paste onto the insulating support 11 by the spin-coating method. The thin-film wire layers 16, multiple layers within the dielectric laminate 12, are deposited by physical vapor deposition such as sputtering or vacuum evaporating and formed into a particular pattern by photo-lithography.

The Josephson devices 13 are fixed to the dielectric laminate 12 through the soldering bumps 14, which thus interconnect the thin-film conductors 16 and the Josephson devices 13.

Since in the abovedescribed manufacturing method the insulating support 11 is manufactured according to a conventionally known ceramic substrate manufacturing method, the thick-film conductors 15 are readily fabricated interiorly. Moreover, the a.c. power supply circuit 1 shown in FIG. 3 is very easy to manufacture, since its structural combination of the impedance-conversion circuits 6, 7 and 8 formed of the resonant lines is simple.

The a.c. power supply circuit 1 is formed, according to the pattern in FIG. 3, of the thick-film conductors 15 interior of the insulating substrate, such that a less superficial area need be occupied on the insulating support 11, thereby reducing the size of the circuit substrate 10 for mounting the Josephson device.

The operation of the circuit will be explained.

The power supplied from the external dual a.c. supplies 4*a* and 4*b*, 180° out of phase, is characterized by higher voltage and smaller current. The power is converted into a lower voltage and a higher current by the first and second resonant line paths 6*a* and 6*b* of the first stage quarter-wave impedance-conversion circuit 6, the first and second resonant line paths 7*a* and 7*b* of the second stage quarter-wave impedance-conversion circuit 7, and the first and second resonant line paths 8*a* and 8*b* of the third stage quarter-wave impedance-conversion circuit 8, in the a.c. power supply circuit 1, whereupon it is supplied to the Josephson device 13. Power is finally grounded from the ground terminals of the Josephson devices through the circuit grounding patterns 15*a* and 15*e*.

The 50-ohm impedance of the external a.c. source 4 is converted to 25 ohms at the first stage quarter-wave impedance-conversion circuit 6, 12.5 ohms at the second stage quarter-wave impedance-conversion circuit 7, and 6.25 ohms at the third quarter-wave impedance-conversion circuit 8, whereby the impedance of the Josephseon devices 13 and the impedance of the supply power are finally matched.

Since the a.c. source 4 provides balanced feeding to the first resonant line paths (6*a*, 7*a*, 8*a*) and the second resonant line paths (6*b*, 7*b*, 8*b*) of the impedance conversion circuits 6, 7 and 8 (namely, since the power is from supplies 180° out of phase to each other), ground noise is reduced.

Other Embodiments (a) The number of stages in the impedance conversion circuit tree may be changed.

(b) An impedance conversion circuit having resonant lines different from quarter-wave length line may be employed.

(c) Circuit grounding paths may be disposed between each of resonant line paths 6*a*, 6*b*, 7*a*, 7*b*, 8*a* and 8*b* of the first and second quarter-wave impedance-conversion circuits.

(d) The impedance values at each stage in the impedance conversion circuits may be changed.

Various details of the invention may be changed without departing from its spirit nor its scope. Furthermore, the foregoing description according to the present invention is provided for the purpose of illustration only, and not for the purpose of limiting the invention as defined by the appended claims and their equivalents.

What is claimed is:

1. An alternating current power supply circuit for supplying alternating current from a source to a plurality of Josephson devices, comprising:

a first impedance-conversion circuit connectable to said source and including a resonant line of length $(2n-1)/4$ of a wavelength of said alternating current power, where n is a positive integer; and m number of second impedance-conversion circuits which include a resonant line of length $(2n-1)/4$ of said alternating current wavelength, where m is a positive integer greater than 1, each of the second impedance-conversion circuits defining a common end and a remaining end, the common ends of each of said second impedance-conversion circuits being connected to said first impedance-conversion circuit in parallel, and the remaining ends of each of said second impedance-conversion circuits being connected to supply input terminals of said plurality of Josephson devices, and a circuit substrate in which the alternating current supply circuit is provided, and wherein the Josephson devices are mounted on the circuit substrate.

2. A circuit according to claim 1, wherein said resonant line is of length one-quarter the wavelength of said alternating current power.

3. A circuit according to claim 2, wherein the number of said second impedance-conversion circuits is two.

4. An alternately current supply device for supplying alternating current from a power source to eight Josephson devices, comprising:

a first impedance-conversion circuit connectable to said power source and including resonant lines of length one-quarter a wavelength of said alternating current power;

two second impedance-conversion circuits including resonant lines of length one-quarter the wavelength of said alternating current power, an end of each one said second impedance-conversion circuits being being connected to said first impedance-conversion circuit; and four third impedance-conversion circuits including resonant lines of length one-quarter the wave length of said alternating current power, wherein each said third impedance-conversion circuit has an end connected to each said second impedance-conversion circuit, such that two of said ends of said third impedance-conversion circuits are connected to each of said second impedance-conversion circuits in parallel;

each of remaining ends thereof is connected to two of said Josephson devices, and a circuit substrate in which the alternating current supply device is provided, and wherein the Josephson devices are mounted on the circuit substrate.

5. An alternating current supply device for supplying alternating current from a power source to eight Josephson devices, comprising:

a first impedance-conversion circuit connectable to said power source and including resonant lines of length one-quarter a wavelength of said alternating current power;

two second impedance-conversion circuits including resonant lines of length one-quarter the wavelength of said alternating current power, an end of each one of said second impedance-conversion circuits being connected to said first impedance-conversion circuit; and four third impedance-conversion circuits including resonant lines of length one-quarter the wave length of said alternating current power, wherein each said third impedance-conversion circuit has an end connected to each said second impedance-conversion circuit, such that two of said ends of said third impedance-conversion circuits are connected to each of said second impedance-conversion circuits in parallel; and each of remaining ends thereof is connected to two of said Josephson devices, wherein said first impedance-conversion circuit has an impedance of 25 ohms; said second impedance-conversion circuit has an impedance of 12.5 ohms; and said third impedance-conversion circuit has an impedance of 6.25 ohms.

6. A device connectable to an alternating current power source, comprising:

a plurality of Josephson devices;

an alternating current supply circuit having a plurality of resonant-line composed impedance conversion circuits interconnected in a tree configuration between said power source and supply input terminals of said Josephson devices; and a circuit substrate in which the alternating current supply circuit is provided, and wherein the Josephson devices are mounted on the circuit substrate.

7. A device according to claim 6, wherein said plurality of impedance conversion circuits includes:

a first impedance-conversion circuit having at least one resonant line of length $(2n-1)/4$ of a wavelength of said alternating current power, where n is a positive integer; and m number of second impedance-conversion circuits including resonant lines of length $(2n-1)/4$ the wavelength of said alternating current power, where m is a positive integer greater than 1, each of the second impedance-conversion circuits defining a common end and a remaining end, the common ends of each of said second impedance-conversion circuits being connected to said first impedance-conversion circuit in parallel, and the remaining ends of each of said second impedance-conversion circuits being connected to said supply input terminals of said plurality of Josephson devices.

8. A circuit substrate as a Josephson device mount, comprising:

an insulative substructure on which a Josephson device is mounted; and an alternating current supply circuit provided in said circuit substrate for supplying alternating current from a power source to said Josephson device, wherein said alternating current circuit includes a plurality of resonant-line composed impedance conversion circuits, interconnected in a tree configuration between said power source and supply input terminals of said Josephson device, wherein said insulative substructure includes an insulative support in which said alternating current power supply circuit is formed, and a dielectric laminate formed on said insulative support and having a portion onto which said Josephson device is mounted.

9. A circuit substrate according to claim 8, wherein said insulative support is made of mullite ceramic.

10. A circuit substrate according to claim 9, wherein said dielectric laminate is made of polyimide.

11. A circuit substrate according to claim 8, wherein said alternating current circuit is formed by thick-film conductors embodied in said insulating substrate.

12. A circuit substrate according to claim 11, wherein said plurality of impedance conversion circuits includes:

a first impedance-conversion circuit connectable to said power source and including resonant lines of length one-quarter a wavelength of said alternating current power;

two second impedance-conversion circuits including resonant lines of length one-quarter the wavelength of said alternating current power, wherein ends common to both of said second impedance-conversion circuits are connected to said first impedance-conversion circuit in parallel; and four third impedance-conversion circuits including resonant lines of length one-quarter the wavelength of said alternating current power, wherein each said third impedance-conversion circuit has an end connected to each said second impedance-conversion circuit, such that two of said ends of said third impedance-conversion circuits are connected to each of said second impedance-conversion circuits in parallel; and each of remaining ends thereof is connected to two Josephson devices.

13. A circuit substrate according to claim 12, wherein said first impedance-conversion circuit has an impedance of 25 ohms; said second impedance-conversion circuit has an impedance of 12.5 ohms; and said third impedance-conversion circuit has an impedance of 6.25 ohms.

14. A circuit substrate according to claim 13, wherein said first impedance-conversion extends in a straight line from an input terminal of said thick-film conductors; said second impedance-conversion circuits branch from said first impedance-conversion circuit, extending in an S; and said third impedance-conversion circuits branch in opposite directions from each of said second impedance-conversion circuits, extending rectilinearly to output terminals of said thick-film conductors to which said supply input terminals of said Josephson device are connected.

15. A substrate according to claim 11, wherein said dielectric laminate includes thin-film conductor layers which function as signal conductors of said Josephson device.

16. A circuit substrate according to claim 8, wherein said plurality of impedance conversion circuits includes:

a first impedance-conversion circuit having at least one resonant line of length $(2n-1)/4$ of a wavelength of said alternating current power, where n is a positive integer; and m number of second impedance-conversion circuits including resonant lines of length $(2n-1)/4$ of the wavelength of said alternating current power, where m is a positive integer greater than 1, each of the second impedance-conversion circuits defining a common end and a remaining end, the common ends of each of said second impedance-conversion circuits being connected to said impedance-conversion circuit in parallel, and the remaining ends of each of said second impedance-conversion circuits being connected to said supply input terminals of said plurality of Josephson devices.

17. A circuit substrate according to claim 16, wherein said resonant lines are of length one-quarter the wavelength of said alternating current power.

18. A substrate according to claim 17, wherein the number of said second impedance conversion circuits is two.

19. A circuit substrate as a Josephson device mount, for supplying power in dual alternating currents which are 180° C. out of phase with each other, from a power source to said Josephson device, comprising:

first and second alternating-current supply-circuit patterns stacked at a given spacing for supplying said power in dual alternating currents to said Josephson device;

first and second circuit-grounding patterns which are interconnected, and which sandwich said first and second alternating-current supply-circuit patterns in their interspaced stacking direction; and an insulative substructure in which said supply-circuit and circuit-grounding patterns are formed, and onto which said Josephson device is mounted.

20. A circuit substrate according to claim 19, wherein each of said first and second alternating-current power-supply circuit patterns comprises:

a first impedance-conversion circuit having at least one resonant line of length $(2n-1)/4$ of a wavelength of said alternating current power, where n is a positive integer; and m number of second impedance-conversion circuits including resonant lines of length $(2n-1)/4$ of the wavelength of said alternating current power, where m is a positive integer greater than 1, each of the second impedance-conversion circuits defining a common end and a remaining end, the common ends of each of said second impedance-conversion circuits being connected to said first impedance-conversion circuit in parallel, and the remaining ends of each of said second impedance-conversion circuits being connected to said supply input terminals of said Josephson device.

21. A circuit substrate according to claim 20, wherein said resonant lines are of length one-quarter the wavelength of said alternating current power.

22. A circuit substrate according to claim 21, wherein the number of said second impedance-conversion circuits is two.

23. A circuit substrate according to claim 19, wherein each of said first and second alternating-current supply-circuit patterns includes a plurality of impedance conversion circuits of patterned resonant lines; and said impedance conversion circuits are interconnected in a tree configuration between said power source and supply input terminals of said Josephson device.

24. A circuit substrate according to claim 23, wherein said impedance conversion circuits are formed by thick-film conductors embodied in said insulating substrate, and superimposed and tiered relative to each other.

25. A circuit substrate according to claim 24, wherein said plurality of impedance conversion circuits comprises:

a first impedance-conversion circuit of patterned resonant lines of which length is one-quarter a wavelength of said alternating current power, to which lines said dual alternating currents are supplied independently;

two second impedance-conversion circuits of patterned resonant lines of which length is one-quarter the wavelength of said alternating current power, common ends of each of said second impedance-conversion circuits being connected to said first impedance-conversion circuit in parallel; and four third impedance-conversion circuits of patterned resonant lines of which length is one-quarter the wavelength of said alternating current power, wherein each of two pairs of said third impedance-conversion circuits has common end connected to each of said second impedance-conversion circuits in parallel; and each of remaining ends of said pairs thereof is connected to source input terminals of two Josephson devices.

26. A substrate according to claim 25, wherein said first impedance-conversion circuit has an impedance of 25 ohms; each said second impedance-conversion circuit has an impedance of 12.5 ohms; and each said third impedance-conversion circuit has an impedance of 6.25 ohms.

27. A circuit substrate according to claim 26, wherein said first impedance-conversion circuit is patterned to extend in a straight line from an input terminal of said thick-film conductors; said second impedance-conversion circuits are patterned to branch from said first impedance-conversion circuit, extending midway in an S; and said third impedance-conversion circuits are patterned to branch in opposite directions from each of said second impedance-conversion circuits, extending rectilinearly to output terminals of said thick-film conductors to which said supply terminals of said Josephson device are connected.

28. A circuit substrate according to claim 27, wherein said third impedance-conversion circuits are each curved in a C about midway portions of said second impedance-conversion circuits, and terminals of each are curved back in upon themselves through approximately 270°.

29. A circuit substrate according to claim 28, wherein said first and second circuit-grounding patterns are connected via conductive metal filling feedthroughs formed in said insulative substructure.

* * * * *